US010415442B2

(12) United States Patent
Kaczmar et al.

(10) Patent No.: US 10,415,442 B2
(45) Date of Patent: Sep. 17, 2019

(54) INTERNAL COMBUSTION ENGINE WITH OIL WARMING WITH DIRECTED SPRAY IN CYLINDER HEAD

(71) Applicant: GM GLOBAL TECHNOLOGY OPERATIONS LLC, Detroit, MI (US)

(72) Inventors: Michael Kaczmar, Farmington Hills, MI (US); Giorgio Candela, Piemonte (IT); Bryan K. Pryor, Waterford, MI (US); Alan E. Bowler, Fenton, MI (US); Mark R. Claywell, Birmingham, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/688,687

(22) Filed: Aug. 28, 2017

(65) Prior Publication Data

US 2019/0063276 A1 Feb. 28, 2019

(51) Int. Cl.

| | |
|---|---|
| ***F01M 5/02*** | (2006.01) |
| ***F01M 5/00*** | (2006.01) |
| ***F01M 1/08*** | (2006.01) |
| ***F01M 9/10*** | (2006.01) |
| ***F01M 11/02*** | (2006.01) |

(52) U.S. Cl.

CPC ..... *F01M 5/021* (2013.01); *F01M 1/08* (2013.01); *F01M 5/007* (2013.01); *F01M 9/101* (2013.01); *F01M 2011/022* (2013.01)

(58) Field of Classification Search

None

See application file for complete search history.

(56) References Cited

U.S. PATENT DOCUMENTS

| | | | | | |
|---|---|---|---|---|---|
| 3,063,435 | A * | 11/1962 | Meurer | F01P 3/14 | 123/41.57 |
| 4,364,339 | A * | 12/1982 | Fricker | F01P 3/02 | 123/41.42 |
| 4,644,910 | A * | 2/1987 | Kawamura | F01M 11/02 | 123/193.5 |
| 4,688,523 | A * | 8/1987 | Takahashi | F01P 3/02 | 123/196 AB |
| 4,688,524 | A * | 8/1987 | Takahashi | F01L 1/0532 | 123/188.9 |
| 2009/0277416 | A1* | 11/2009 | Saito | F01M 11/0004 | 123/196 AB |
| 2009/0301414 | A1* | 12/2009 | Netsu | F01M 5/00 | 123/41.72 |

(Continued)

FOREIGN PATENT DOCUMENTS

| | | | |
|---|---|---|---|
| JP | 06200724 | A * | 7/1994 |
| JP | 2005214020 | A * | 8/2005 |

*Primary Examiner* — Hung Q Nguyen
*Assistant Examiner* — Brian P Monahon
(74) *Attorney, Agent, or Firm* — Harness, Dickey & Pierce, P.L.C.

(57) ABSTRACT

An internal combustion engine includes an engine block including a plurality of cylinders. A cylinder head is mounted to the engine block and includes intake and exhaust passages in communication with the plurality of cylinders. A cylinder head cover is mounted to the cylinder head and defines a cavity between the cylinder head and the cylinder head cover. An oil passage is disposed in the cavity and includes at least one oil jet for spraying oil at a surface of the cylinder head that is heated by the exhaust passages.

4 Claims, 3 Drawing Sheets

(56) References Cited

U.S. PATENT DOCUMENTS

| | | | | |
|---|---|---|---|---|
| 2012/0160197 | A1* | 6/2012 | Matsunaga | F01L 1/0532<br>123/90.15 |
| 2015/0136066 | A1* | 5/2015 | Hikita | F01M 9/101<br>123/196 R |

* cited by examiner

INTERNAL COMBUSTION ENGINE WITH OIL WARMING WITH DIRECTED SPRAY IN CYLINDER HEAD

FIELD

The present disclosure relates to an internal combustion engine and more particularly to an internal combustion engine having oil warming with directed spray in the cylinder head.

BACKGROUND

This section provides background information related to the present disclosure which is not necessarily prior art.

Internal combustion engines utilizing active oil warming technologies use exhaust energy, transferred to coolant as a means of distributing the waste heat energy to the engine oil to increase the warm-up rate of the engine. The viscosity of the warmed oil decreases and the internal engine friction is more quickly reduced. Conventional means involve directing the warmed engine coolant to an oil/coolant heat exchanger. While this has proven effective, there is energy wasted in warming all of the passages from the exhaust cooling core to the coolant/oil heat exchanger. Accordingly, it is desirable to provide an improved method of oil warming for providing improved thermal efficiency and friction reduction.

SUMMARY

This section provides a general summary of the disclosure, and is not a comprehensive disclosure of its full scope or all of its features.

The present disclosure utilizes a portion of the lubricating oil supply directed to the cylinder and sprays it on the upper side of the exhaust cooling jacket in the cylinder head, thereby warming the oil. An alternative option is to remove a portion of the exhaust cooling jacket so that the heat of the exhaust can be transferred directly to the oil through a single casting wall instead of an intermediate coolant jacket.

An internal combustion engine includes an engine block including a plurality of cylinders. A cylinder head is mounted to the engine block and includes intake and exhaust passages in communication with the plurality of cylinders. A cylinder head cover is mounted to the cylinder head and defines a cavity between the cylinder head and the cylinder head cover. An oil passage is disposed in the cavity and includes at least one oil jet for spraying oil at a surface of the cylinder head that is heated by the exhaust passages.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3:
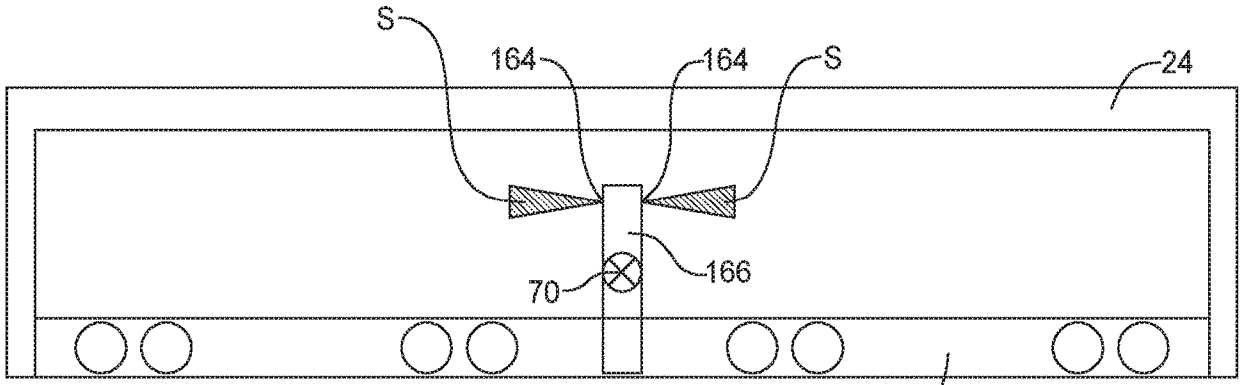
Figure 4:
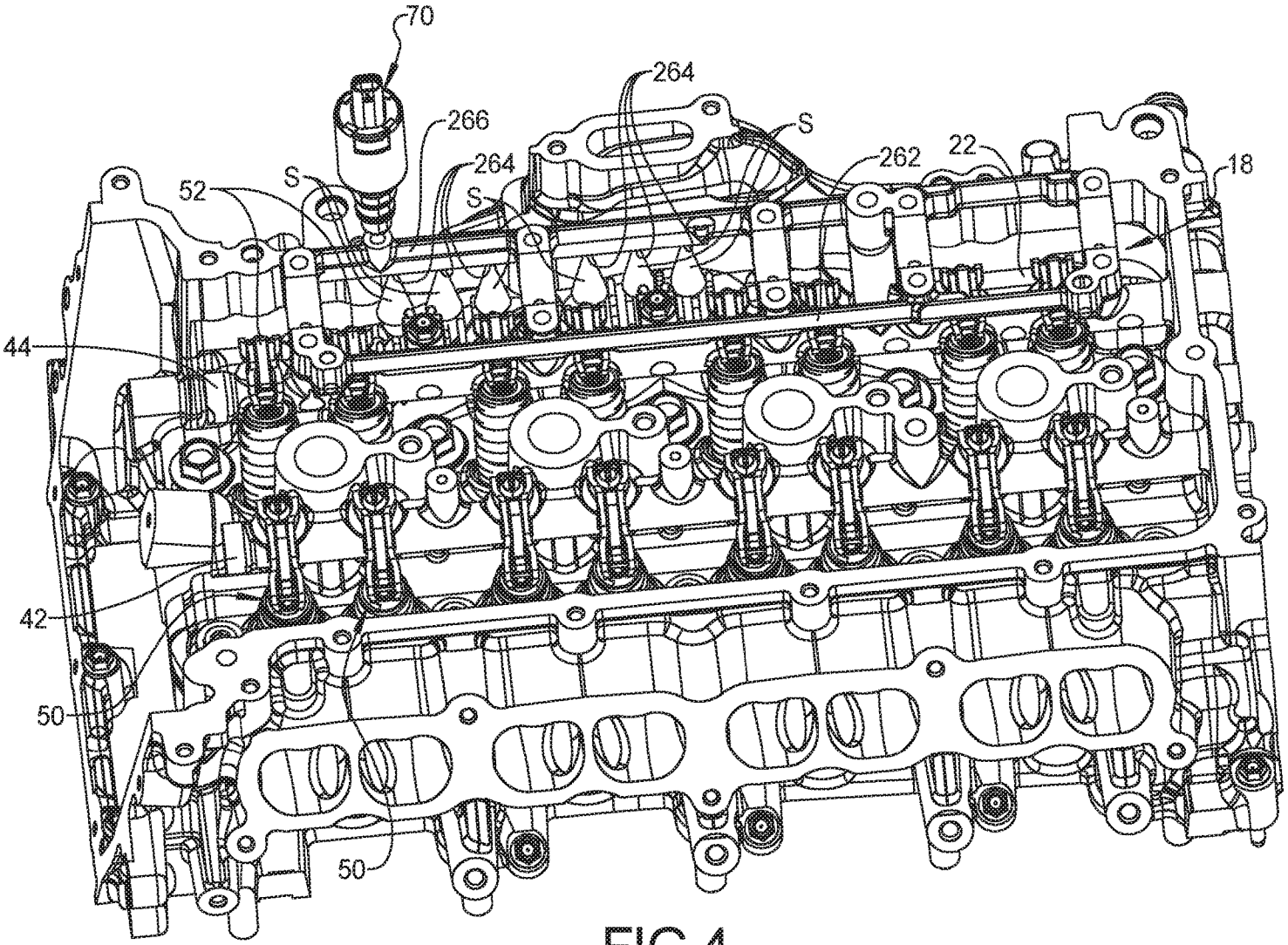

FIG. 3 is a schematic view of oil jets within the cylinder head cover for spraying oil on the cylinder head according to an alternative embodiment of the present disclosure; and FIG. 4 is a perspective view of a cylinder head and valve train including an oil passage that delivers oil to the cam bearings and further includes a control valve that further controls the supply of oil to a plurality of oil jets.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
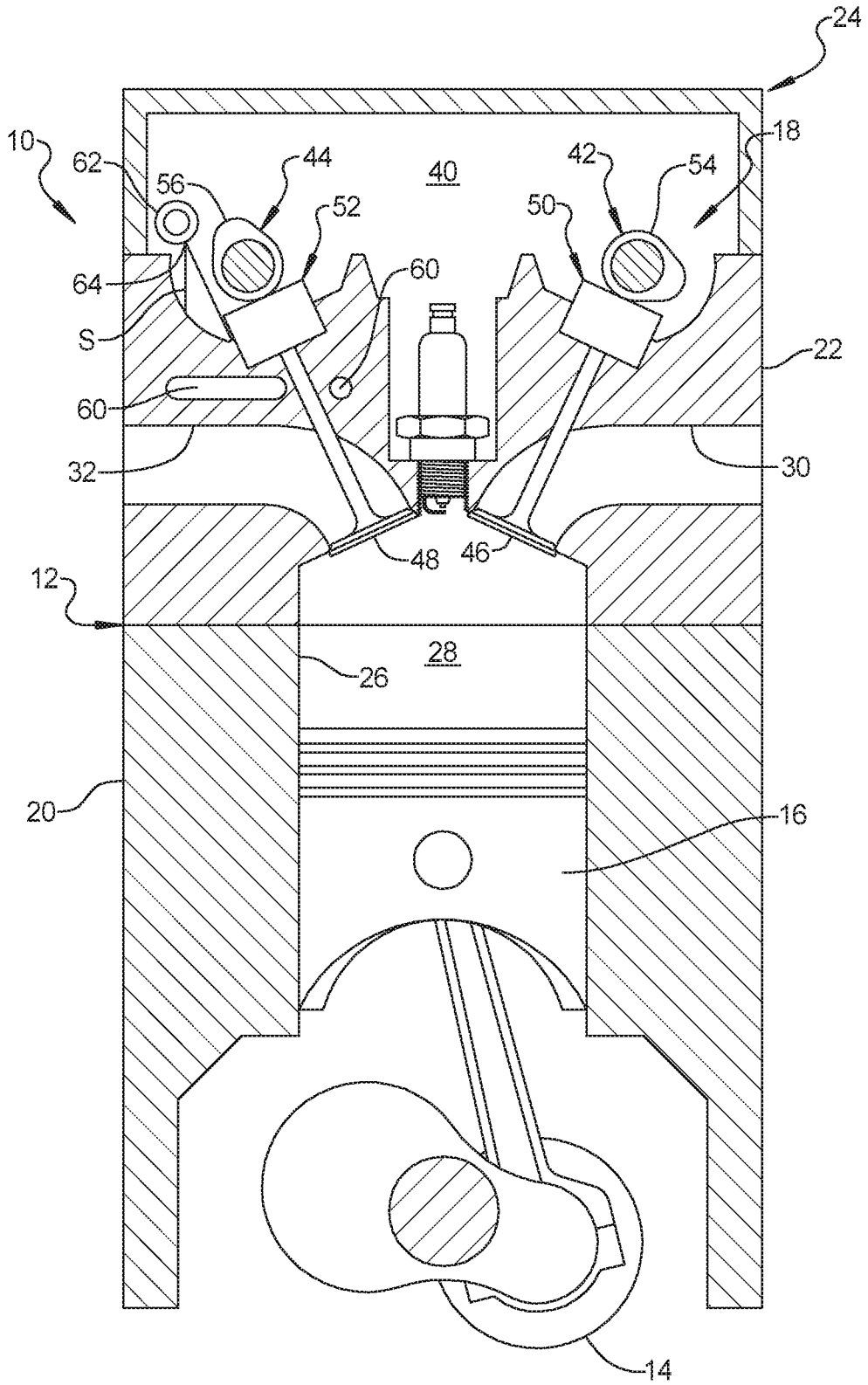
FIG. 1 is a schematic view of an internal combustion engine having an oil warming system according to the principles of the present disclosure.

With reference to FIG. 1, an engine assembly 10 includes an engine structure 12, a crankshaft 14, pistons 16 and a valve train assembly 18. The engine structure 12 includes an engine block 20, a cylinder head 22 coupled to the engine block 20, and a cylinder head cover 24 coupled to the cylinder head 22. The engine block 20 includes cylinder bores 26 that receive the pistons 16. The cylinder head 22 cooperates with the engine block 20 to define combustion chambers 28. The cylinder head 22 may additionally define intake and exhaust ports 30, 32 in communication with the combustion chambers 28. It is understood that the present teachings apply to any number of piston-cylinder arrangements including, but not limited to, V-engines, inline engines, and horizontally opposed engines, as well as both overhead cam and cam-in-block configurations.

The cylinder head cover 24 is coupled to the cylinder head 22 and defines a cavity 40 between the cylinder head cover 24 and the cylinder head 22.

The valve train assembly 18 may include intake and exhaust camshafts 42, 44, intake valves 46 located in the intake ports 30, exhaust valves 48 located in the exhaust ports 32, intake valve lift mechanisms 50 and exhaust valve lift mechanisms 52. The intake and exhaust camshafts 42, 44 may be supported for rotation on the engine structure 12, and more specifically on the cylinder head 22. The intake camshaft 42 may include intake lobes 54 and the exhaust camshaft 44 may include exhaust lobes 56. The intake valve lift mechanisms 50 may be engaged with the intake lobes 54 and the intake valves 46 and the exhaust valve lift mechanisms 52 may be engaged with the exhaust lobes 56 and the exhaust valves 48. The cylinder head 22 includes a coolant jacket therein including coolant passages 60.

Figure 2:
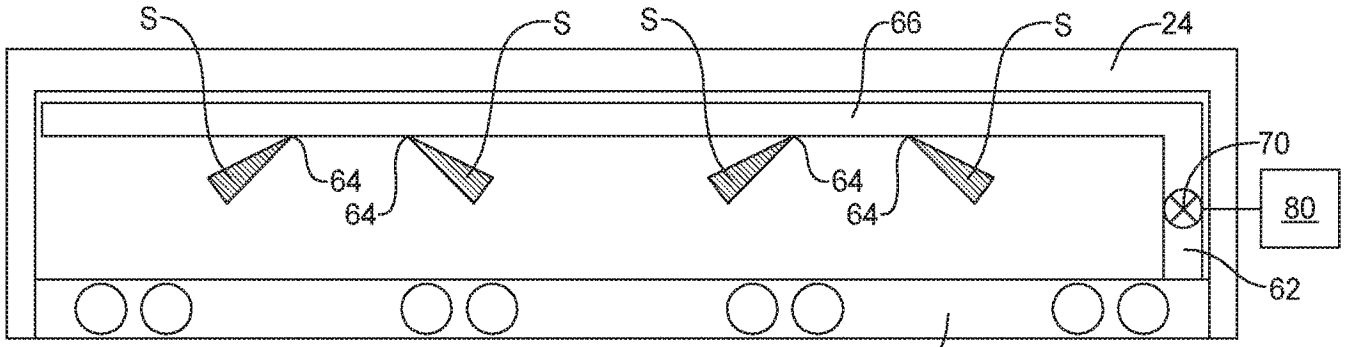
FIG. 2 is a schematic view of oil jets within the cylinder head cover for spraying oil on the cylinder head according to the principles of the present disclosure.

An oil warming system includes an oil passage 62 disposed in the cavity 40. The oil passage 62 can include a plurality of jets 64 for spraying a stream of oil S on a surface of the cylinder head 22 opposite the exhaust ports 32. As shown in FIG. 2, the oil passage 62 can be in the form of a rail 66 that can extend along the cylinder head 22. The plurality of jets 64 can be spaced along the rail 66 to spray oil along the integrated exhaust manifold cooling jacket 60. An oil control valve or thermostat 70 is provided in the oil passage 62 to control the flow of oil to the plurality of jets 64. By way of example, when the oil temperature is below a predetermined temperature level at startup, the present disclosure utilizes a portion of the lubricating oil supply that is directed to one or more of the cylinders, valves, bearings, lash adjusters and other components and sprays it on an upper side of the exhaust cooling jacket in the cylinder head, thereby warming the oil. An alternative option is to remove a portion of the exhaust cooling jacket so that the heat of the exhaust can be transferred directly to the oil through a single casting wall instead of an intermediate coolant jacket. The oil control valve or thermostat 70 can be designed to be opened when the oil is below a predetermined temperature and to be closed after the oil has warmed up to a predetermined temperature. The use of thermostat 70 can cause the valve to close automatically, while a controller 80 can be used to control an oil control valve 70. The oil drains through the cylinder head 22 and engine block 20 to an oil pan (not shown) where it heats the remaining oil more quickly than conventional engines.

As shown in FIG. 3, the plurality of jets 164 can be disposed on a vertical rail 166 and can be directed to spray the oil in opposite directions from a central location. A thermostat or oil control valve 70 can control a flow of oil to the oil jets 164.

As shown in FIG. 4, a perspective view of a cylinder head 22 and a valve train 18 is shown including an oil passage 262 that delivers oil to the cam bearings and valves and further includes a control valve 70 that further controls the supply of oil to the plurality of oil jets 264 that can be downstream of the cam bearings. The plurality of oil jets 264 sprays the oil on an upper side of the exhaust cooling jacket 60 in the cylinder head 22, thereby warming the oil. Once the oil reaches a predetermined temperature, the control valve 70 is closed to close off the portion of the passage 266 that supplies the oil jets 264 while the remaining passage 262 is connected to the cam bearings and valves and continues to supply oil thereto.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An internal combustion engine, comprising:

an engine block including a plurality of cylinders;

a cylinder head mounted to the engine block, the cylinder head including intake and exhaust passages in communication with the plurality of cylinders;

a cylinder head cover mounted to the cylinder head and defining a cavity between the cylinder head and the cylinder head cover; and an oil passage disposed in the cavity and including at least one oil jet for spraying oil at a surface of the cylinder head that is heated by the exhaust passages during engine operation, wherein the oil passage includes a thermostat valve for allowing the flow of oil in the oil passage and from the at least one oil jet when a temperature of the oil is below a predetermined temperature and prevents the flow of oil therein when a temperature of the oil is above the predetermined temperature.

2. The internal combustion engine according to claim 1, wherein the cylinder head includes coolant passages disposed within the cylinder head.

3. The internal combustion engine according to claim 1, wherein the oil passage includes a rail extending along the cylinder head and having a plurality of spaced oil jets directed toward the surface of the cylinder head that is heated by the exhaust passages.

4. The internal combustion engine according to claim 1, wherein the oil passage includes a rail having a pair of oil jets extending in opposite direction along the cylinder head.

* * * * *